US005456466A

United States Patent [19]

Miles

[11] Patent Number: 5,456,466

[45] Date of Patent: Oct. 10, 1995

[54] ENTERTAINMENT MACHINES

[75] Inventor: Michael J. Miles, Stockport, United Kingdom

[73] Assignee: Barcrest Ltd., Lancashire, England

[21] Appl. No.: 184,558

[22] Filed: Jan. 21, 1994

[30] Foreign Application Priority Data

Nov. 3, 1993 [GB] United Kingdom ..... 9322689

[51] Int. Cl.[6] ..... A63F 5/04

[52] U.S. Cl. ..... 273/143 R; 273/138 A

[58] Field of Search ..... 273/143 R, 138 A, 273/138 R, 85 CP

[56] References Cited

U.S. PATENT DOCUMENTS

| | | | |
|---|---|---|---|
| 4,448,419 | 5/1984 | Telnaes | 273/143 R |
| 4,711,451 | 12/1987 | Pajak et al. | 273/143 R |
| 4,772,023 | 9/1988 | Okada | 273/143 R |
| 4,858,932 | 8/1989 | Keane | 273/143 R |
| 5,074,559 | 12/1991 | Okada | 273/143 R |
| 5,083,785 | 1/1992 | Okada | 273/143 R |
| 5,102,134 | 4/1992 | Smyth | 273/143 R |
| 5,102,137 | 4/1992 | Ekiert | 273/143 |
| 5,108,099 | 4/1992 | Smyth | 273/143 R |
| 5,263,717 | 11/1993 | Smyth | 273/143 R |

FOREIGN PATENT DOCUMENTS

| | | | |
|---|---|---|---|
| 0021279 | 1/1991 | Japan | 273/143 R |
| 2131587 | 6/1984 | United Kingdom | 273/143 R |

*Primary Examiner*—Jessica J. Harrison

[57] ABSTRACT

A coin-operated entertainment machine has three or four rotatable reels with selectable symbols around their peripheries. The machine is operated by a player, after actuation by insertion of one or more coins, to cause the reels to rotate and come to rest with a combination of symbols displayed on a win line. If the combination is of a predetermined winning nature, an award, such as a payout of coins, is made available to the player. The operating system of the machine assigns an index to each selectable symbol whereby the selected combination can be known before this is displayed to the player. Each winning combination has an assigned rejection probability and any selected winning combination is subjected to an acceptance/rejection procedure using the assigned probability before it is displayed. If it is rejected, a new combination is selected and the procedure is repeated.

10 Claims, 2 Drawing Sheets

ENTERTAINMENT MACHINES

BACKGROUND OF THE INVENTION

1. Field of the Invention

This invention relates to a coin-operated symbol-selecting entertainment machine, that is, a machine of the kind which is operated by a player, after actuation by insertion of one or more coins, to play a game involving selection of a combination of symbols, whereby an award is made available in the event that the combination is of a predetermined winning nature.

As used herein the term coin-operated is intended to cover operation by tokens, credit cards or any other form of monetary value or means of establishing game-playing credit.

Coin-operated symbol-selecting machines of the fruit machine or poker machine kind commonly have a number of rotatable reels with symbols around their peripheries. The reels are rotated and are brought to rest with selected symbols displayed through a window on one or more win lines.

The stopping position may be randomly determined by a software routine which involves selection from a list of numbers one for each of the different possible stopping positions of the respective reel.

With this arrangement, considering by way of example three reels each having 24 possible stopping positions, the least likely combination (i.e. three symbols which appear only once on each reel) has odds of 1 in 13824 (24×24×24). These odds are not small enough for it to be viable to payout a large jackpot win (of say 10,000 game credits) together with regular smaller payouts. A payout of 10,000 credits at odds of 1 in 13824 represents approximately 72% return whereby payouts would have to be very infrequent to retain profitability.

2. Description of the Prior Art

To overcome this limitation, U.S. Pat. No. 448,419 proposes the use of an enlarged 'virtual reel' which has more stopping positions than the actual reel. Selection is effected at random from a list of numbers which is greater than the number of stopping positions, at least some of the stopping positions having two or more numbers in the list which correspond. In this way, if the virtual reel (list of numbers) is say twice the size of the actual reel, with three 24 position reels the odds for the least likely combination would be 1 in 110592.

Another proposal is contained in U.S. Pat. No. 4,858,932. Each stopping position for each reel is assigned a group of sub-intervals or a probability factor. Random selection is effected through the sub-intervals or probability factors and there is an increased likelihood that the stopping position selected will be one to which a larger group of sub-intervals or a higher probability factor has been assigned. This is equivalent to the use of an enlarged 'virtual reel' in that the stopping positions through which the selection is made are effectively expanded compared with the actual reel.

SUMMARY

An object of the present invention is to decrease the odds for selection of the least likely symbol combination without requiring the use of an enlarged virtual reel or its equivalent.

According to the invention therefore there is provided a coin-operated symbol-selecting entertainment machine of the kind which is operated by a player, after actuation by insertion of one or more coins, to play a game involving selection of a combination of symbols, whereby an award is made available in the event that the combination is of a predetermined winning nature, wherein the machine has an operating system which selects said symbol combination from a plurality of groups of symbol positions, a respective index is assigned to each symbol position in each group, and the system operates to select one said index for each group for the purpose of selecting the corresponding symbol for the said combination, characterized in that a respective rejection probability is assigned to each said combination and, after selecting the said indexes these are subjected to an acceptance/rejection procedure using the corresponding assigned rejection probability.

whereby the selected indexes are used for selecting the said symbol combination if accepted but are re-selected if rejected.

With this arrangement, even though only one selectable index is assigned to each selectable symbol position, the odds for random selection of a predetermined symbol combination, such as a jackpot combination, can be much reduced as desired by appropriate utilization of the acceptance/rejection procedure with a suitably high rejection probability applied to the combination.

BRIEF DESCRIPTION OF DRAWINGS

The invention will now be described further by way of example only and with reference to the accompanying drawings in which.

DESCRIPTION

Figure 1:
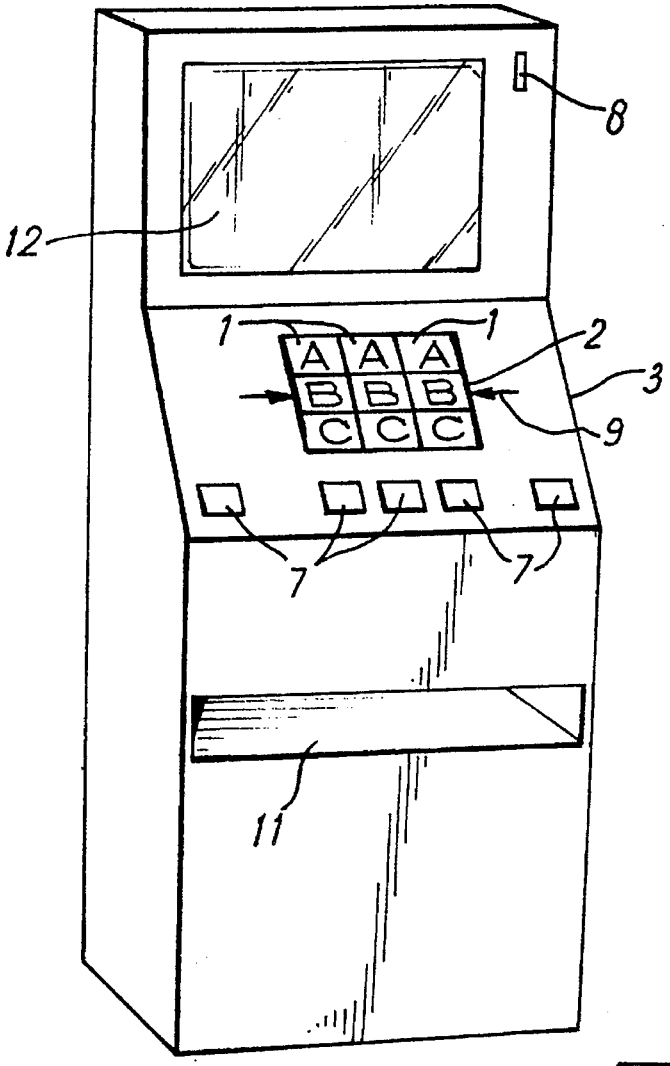
FIG. 1 is a diagrammatic front perspective view of one form of a machine according to the invention.
Figure 2:
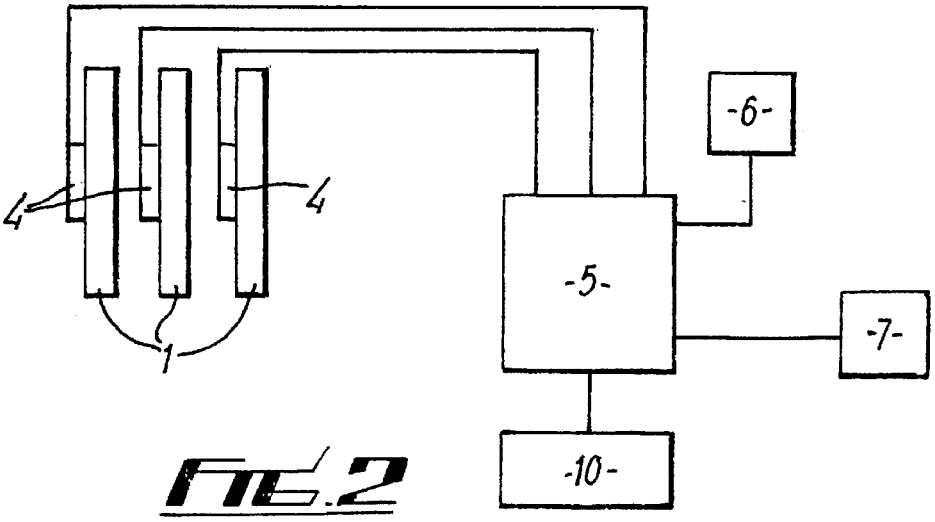
FIG. 2 is a block circuit diagram of the machine.

It is visualized that the invention will find particular application in the context of a machine having a number of rotatable reels (say three or four) whereby the symbols are disposed around the peripheries of the reels at respective stopping positions. In this case the invention permits the attainment of reduced odds without using enlarged virtual reels for selection purposes. Indeed, the reduction in odds is obtained by reference to a selected combination not to the selection of an individual reel, the outcome of this then being used to reselect one or more (and preferably all) reel stopping positions.

The procedure is therefore quite different from the known enlarged virtual reel arrangement in which the odds reducing modification is attained and with reference to the individual reels, and this gives rise to important advantages in terms of additional opportunities for flexibility of control.

The entertainment machine has three or four symbol-bearing reels 1 (three are shown) rotatable behind a window 2 in a cabinet 3. The reels 1 are rotated with respective stepper motors 4 controlled by a microprocessor-based operating system 5 which is actuated by a coin-mechanism 6 and player controls 7. Each reel 1 has, say 24 symbol-bearing positions around its periphery. Some symbols are used more than once. One jackpot symbol appears only once on each reel.

In use, the machine is actuated by insertion of one or more coins into the coin mechanism 6 via a slot 8, the player operates the controls 7 to set the reels 1 in rotation, the operating system 5 arrests the reels 1 in stopping positions randomly predetermined by a software routine so that a selected combination of symbols is displayed to the player on a win line 9 through the window 2, and the player receives a pay-out of coins or other prize in the event that the combination is of a predetermined wining nature, from a payout mechanism 10 which feeds to an outlet 11. The machine has a top display 12 which may comprise the usual win chart and/or an auxiliary game display.

In software in the operating system 5 a respective index is assigned to each stopping position of each reel 1. At the start of each game one index is selected at random for each reel. The corresponding symbol combination for the selected indexes is checked to see if it is a winning combination. If the combination is not a winning combination the reels 1 are rotated and are brought to rest so that the pertaining combination of symbols is displayed on the win line 9.

If the combination is a winning combination a respective predetermined rejection probability assigned to that combination is 'looked up' in memory in the operating system. An acceptance/rejection decision procedure is then initiated using the predetermined rejection probability.

If the result of this procedure is an acceptance decision, then the reels 1 are rotated and are brought to rest with the winning combination displayed.

If the result of the procedure is a rejection, the combination is not displayed. The selected indexes are rejected. The selection procedure starts again.

Figure 3:
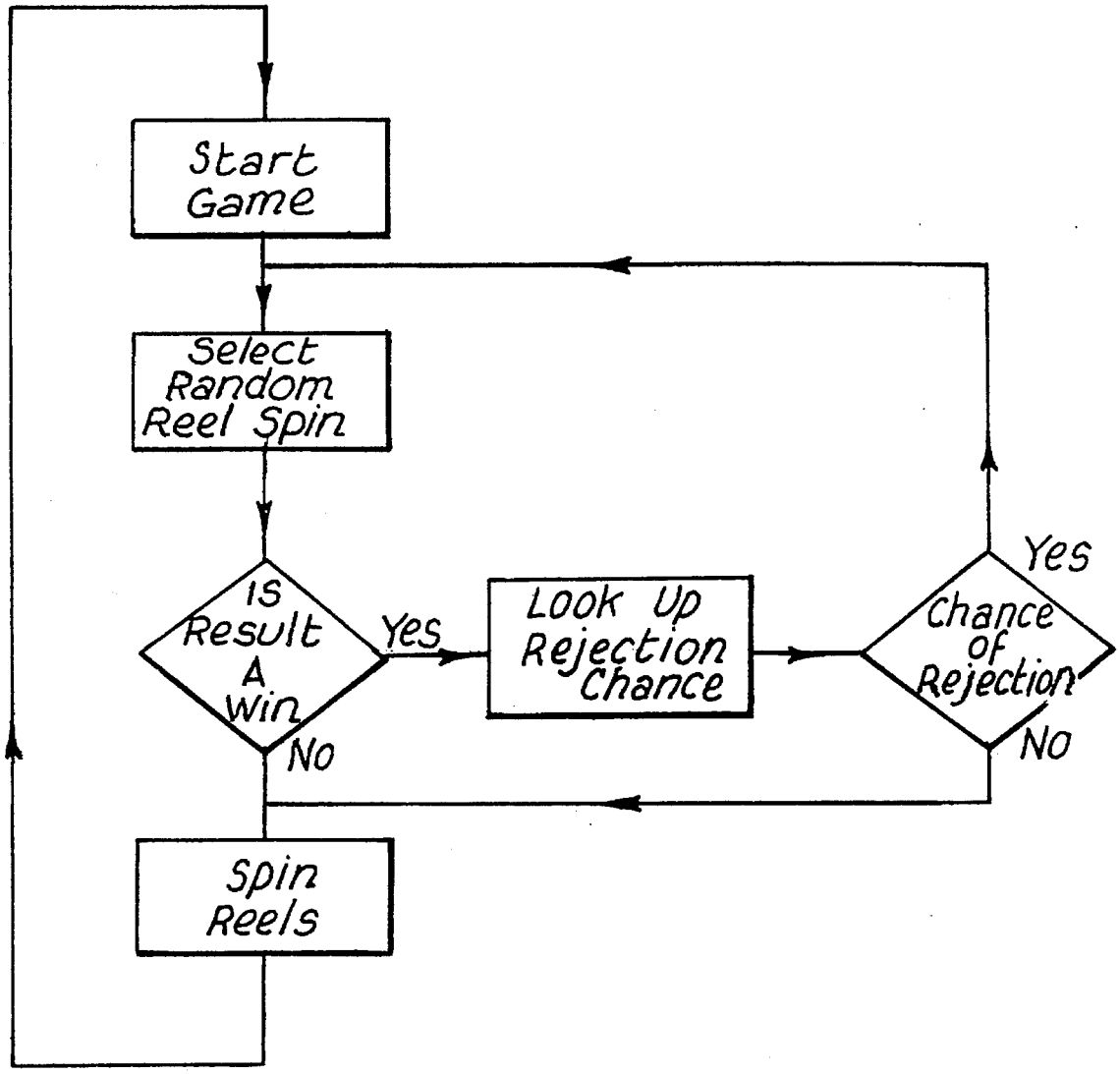
FIG. 3 is a flow diagram for the operating system of the machine.

The above described recursive selection procedure is illustrated in the accompanying flow chart of FIG. 3.

A practical example with the above described system will now be described.

Assuming three reels each with 24 symbol positions (stopping positions) and 7 different symbols (designated A to G), with A, B and C appearing once, D appearing twice, E appearing three times, F appearing four times, and G appearing twelve times, a desired payout structure (related to 1 unit of credit required to purchase a game) is as follows:

| | | | |
|---|---|---|---|
| A | A | A | 10,000 units of credit |
| B | B | B | 5,000 units of credit |
| C | C | C | 250 units of credit |
| D | D | D | 100 units of credit |
| E | E | E | 10 units of credit |
| F | F | F | 5 units of credit |
| G | G | G | 2 units of credit |

That is, 10,000 is paid out for a jackpot win of a combination of three A symbols, and lesser amounts are paid out for other three-symbol combinations.

Using a simple random selection (reel spin) for each reel without applying the above mentioned recursive procedure, the percentage return can be calculated as follows, related to the above payouts:

| Combinations | Frequencies | Hits | Win | Total | Percentage |
|---|---|---|---|---|---|
| A A A | 1 1 1 | 1 | 10,000 | 10,000 | 72.34 |
| B B B | 1 1 1 | 1 | 5,000 | 5,000 | 36.17 |
| C C C | 1 1 1 | 1 | 500 | 500 | 3.62 |

-continued

| Combinations | Frequencies | Hits | Win | Total | Percentage |
|---|---|---|---|---|---|
| D D D | 2 2 2 | 8 | 100 | 800 | 5.79 |
| E E E | 3 3 3 | 27 | 10 | 270 | 1.95 |
| F F F | 4 4 4 | 64 | 5 | 320 | 2.31 |
| G G G | 12 12 12 | 1728 | 2 | 3456 | 25.00 |
| | Total | 1830 | | | 147.18 |

The number of possible combinations is 24×24×24 (13824) and, as shown above this would result in a win frequency of 1 hit every 7.55 games. The return (payout ratio) of 147.18% is of course unacceptable.

Considering now the application of rejection probabilities with the above described recursive procedure, the above figures would be changed as follows:

| Combinations | Theory Hits | Reject | Actual Hits | Win | Total | Percentages |
|---|---|---|---|---|---|---|
| A A A | 1 | 0.5 | 0.5 | 10,000 | 5,000 | 37.58 |
| B B B | 1 | 0.4 | 0.6 | 5,000 | 3,000 | 22.55 |
| C C C | 1 | 0.2 | 0.8 | 500 | 400 | 3.01 |
| D D D | 8 | 0.15 | 6.8 | 100 | 680 | 5.11 |
| E E E | 27 | 0 | 27 | 10 | 270 | 2.03 |
| F F F | 64 | 0 | 64 | 5 | 320 | 2.41 |
| G G G | 1728 | 0.3 | 1209.6 | 2 | 2419.2 | 18.18 |
| Total | 1830 | | 1309.3 | | | 90.87 |

The game cycle is reduced from 13824 to 13303.3 because 520.7 hits are rejected. This gives an actual win frequency of 1 hit every 10.16 games, and a desirable return of 90.87% is attained.

With this arrangement without need either to physically enlarge the reels (i.e. increase the actual number of stopping positions) or to use enlarged virtual reels in software, it is possible to provide a machine with a good win frequency (to retain the interest of the player) and a high jackpot payout.

It is of course to be understood that the invention is not intended to be restricted to the above details which are described by way of example only.

I claim:

1. A coin-operated symbol-selecting entertainment machine for operation by a player, said machine activated by insertion of at least one coin to select and display a combination of symbols, whereby an award is delivered when a preselected winning combination is displayed, the machine having an operating system which pre-selects said combination of symbols from a plurality of groups of symbol positions, said operating system comprising index assigning means which assigns a respective index to each symbol position in each group, and index selection means which operates to select one said index for each position for the purpose of selecting a combination of symbols corresponding to the respective indexes, said operating system further comprising probability assigning means to assign respective rejection probabilities to each combination and, assessment means which subjects each pre-selected symbol combination to an acceptance/rejection procedure using the rejection probability assigned to the said combination by the probability assigning means, and symbol combination selection means operable to select and display a symbol combination corresponding to selected indexes accepted by the assessment means, said index selection means operable to re-select said indexes if selected indexes are rejected by the assessment means.

2. A machine according to claim 1 wherein said index selection means operates repeatedly to re-select said indexes following rejection thereof until an acceptable combination is obtained by said acceptance means.

3. A machine according to claim 1 wherein all winning combinations have rejection probabilities assigned thereto.

4. A machine according to claim 1, having a plurality of rotatable reels, whereby the said symbols are disposed around the peripheries of the reels at respective stopping positions, the reels being rotated and then arrested at one of said stopping positions so as to display a selected combination of said symbols on a win line.

5. A machine according to claim 4 wherein there are three reels.

6. A machine according to claim 5 wherein each reel has 24 stopping positions.

7. A machine according to claim 4 wherein there are four reels.

8. A machine according to claim 7 wherein each reel has 24 stopping positions.

9. A machine according to claim 1 having stepped motors for rotating and arresting the reels and a microprocessor-based control system for controlling operation of the stepper motors.

10. A machine according to claim 1 wherein the said award constitutes a pay-out of coins.

* * * * *